US012097551B2

(12) United States Patent
Rudert et al.

(10) Patent No.: US 12,097,551 B2
(45) Date of Patent: Sep. 24, 2024

(54) METHOD FOR PRODUCING A SCREW FOUNDATION FOR SECURING ELEMENTS IN THE GROUND

(71) Applicant: Winkelmann Foundation Screw Sp. z o.o., Legnica (PL)

(72) Inventors: Bernd Rudert, Ahlen (DE); Karl-Heinz Hecker, Ahlen (DE); Ralf Pottgueter, Ahlen (DE)

(73) Assignee: Winkelmann Foundation Screw Sp. z o.o., Legnica (PL)

( * ) Notice: Subject to any disclaimer, the term of this patent is extended or adjusted under 35 U.S.C. 154(b) by 285 days.

(21) Appl. No.: 17/766,416

(22) PCT Filed: Oct. 6, 2020

(86) PCT No.: PCT/EP2020/077904
§ 371 (c)(1),
(2) Date: Apr. 4, 2022

(87) PCT Pub. No.: WO2021/073927
PCT Pub. Date: Apr. 22, 2021

(65) Prior Publication Data

US 2023/0173571 A1 Jun. 8, 2023

(30) Foreign Application Priority Data

Oct. 17, 2019 (DE) ..... 10 2019 128 030.3

(51) Int. Cl.
*B21D 53/24* (2006.01)
*B21D 22/16* (2006.01)
*E04H 12/22* (2006.01)

(52) U.S. Cl.
CPC ..... *B21D 53/24* (2013.01); *B21D 22/16* (2013.01); *E04H 12/2223* (2013.01)

(58) Field of Classification Search
CPC ..... B21D 53/24; B21D 22/16; B21H 3/02; B21H 3/022; B23G 7/00; B23G 7/02; E04H 12/2223; E04H 12/2215
(Continued)

(56) References Cited

U.S. PATENT DOCUMENTS 3,507,183 A * 4/1970 Thurston ..... F16B 25/0021 470/84
7,007,910 B1 * 3/2006 Krinner ..... E04H 12/2223 52/165

(Continued)

FOREIGN PATENT DOCUMENTS

DE 198 36 370 A1 2/2000
DE 10 2010 010 603 A1 9/2011

(Continued)

OTHER PUBLICATIONS

International Search Report in PCT/EP2020/077904, mailed Feb. 3, 2021.

*Primary Examiner* — Mohammed S. Alawadi
(74) *Attorney, Agent, or Firm* — Collard & Roe, P.C.

(57) ABSTRACT

A method for producing a screw foundation for securing elements in the ground, provides a cylindrical tube as an initial form and a conical front portion tapering to an insertion tip is then molded on to the cylindrical tube using a non-cutting process, the front portion being provided at least in some regions with a thread-like contour for screwing into the ground. An inner contour for a screwing tool is formed integrally in a rear end of the tube by flow forming, and the front portion and the thread-like contour are formed exclusively by flow forming.

10 Claims, 2 Drawing Sheets

Figure 1:
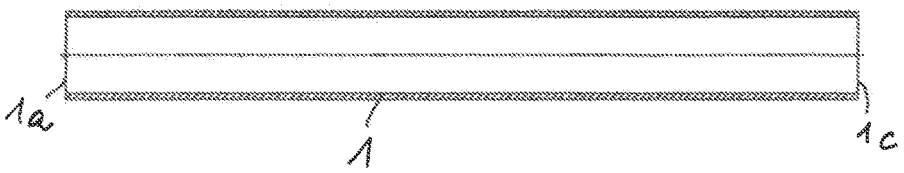

(58) Field of Classification Search
USPC ..... 470/84; 72/103
See application file for complete search history.

(56) References Cited

U.S. PATENT DOCUMENTS

| | | | | |
|---|---|---|---|---|
| 8,484,909 | B2 | 7/2013 | Thurner et al. | |
| 9,421,591 | B2 | 8/2016 | Thurner | |
| 2012/0117893 | A1* | 5/2012 | Thurner | E04H 12/2223 52/157 |
| 2018/0209139 | A1* | 7/2018 | Tu | B21K 1/46 |

FOREIGN PATENT DOCUMENTS

| | | | |
|---|---|---|---|
| DE | 10 2010 043 785 | B3 | 3/2012 |
| FR | 2301318 | A1 | 9/1976 |

* cited by examiner

METHOD FOR PRODUCING A SCREW FOUNDATION FOR SECURING ELEMENTS IN THE GROUND

CROSS REFERENCE TO RELATED APPLICATIONS

This application is the National Stage of PCT/EP2020/077904 filed on Oct. 6, 2020, which claims priority under 35 U.S.C. § 119 of German Application No. 10 2019 128 030.3 filed on Oct. 17, 2019, the disclosure of which is incorporated by reference. The international application under PCT article 21(2) was not published in English.

The invention relates to a method for producing a ground screw foundation for securing elements in the ground, in which method a cylindrical tube is provided as an initial form, and subsequently a conical front section is formed on the cylindrical tube, by means of a non-cutting process, which section tapers to an insertion tip, wherein the front section is provided, at least in certain sections, with a thread-like contour so that it can be screwed into the ground.

At the rear end, a ground screw foundation can be configured so that poles or rods can be inserted into it, or it can have a flange-like securing attachment at the rear end, onto which other elements, for example frames or the like, can be screwed.

Such a method is known from DE 198 36 370 C2. This method for the production of a securing apparatus for rods, posts, masts or the like in the ground, in particular the production of a ground anchor, having a base body, wherein at least a partial section of the base body is provided with a screw-like or worm-like outside thread that can be screwed into and back out of the ground, and wherein the base body has essentially a cone-shaped base form with at least one conical partial section, is characterized in that the base body is produced by hammering the base body into the base form, starting with an essentially cylindrical tube.

It is true that this method does offer advantages in production as compared with metal-casting methods, but it is still relatively complicated, because only the base form is produced by means of shaping, namely by hammering a tube to form it. Subsequently, however, it is necessary to weld the outside thread onto the base body as a shaped part, and to affix further fin-like surface elements onto the base body, if necessary, preferably also by means of welding. This method is therefore also complicated.

It is the object of the invention to significantly simplify the production of a ground screw foundation for securing elements in the ground.

This object is accomplished, in the case of a method of the type stated initially, according to the invention, in that an inner contour for a screw-in tool is formed in a rear end of the tube by means of flow forming, and that the front section and the thread-like contour are formed exclusively by means of flow forming.

The ground screw foundation is therefore produced solely by means of flow forming, and thereby the production effort is clearly reduced, and precise and reproducible components can be produced. In this regard, first the inner contour and then the front section and the thread-like contour can be produced or vice versa. As an initial form, a drawn or welded tube can be used.

In a particularly preferred embodiment it is provided that the tube is first elongated, at least in certain sections. In this way, the material properties, on the one hand, and the geometrical dimensions, on the other hand, can be changed.

According to a first embodiment, it is provided that the front section is formed first, and the thread-like contour is formed afterward.

In this regard, it can be provided that the thread-like contour is also formed in the region of the tube that borders on the front section, at least in certain sections.

Alternatively it can be provided that the front section and the thread-like contour are formed at the same time.

In this regard, the thread-like contour can be formed with different flank geometries and/or different pitches in different regions.

In a further embodiment it is provided that the tube is arranged on an inner mandrel during flow forming, at least part of the time. An inner mandrel is used, for example, for the production of the inner contour.

In this regard, it can also be provided that a multi-part inner mandrel is used.

Furthermore it is practical if a tailstock is introduced into the front section during flow forming, at least part of the time.

This tailstock can be controlled under the effect of a spring or by machine.

If a completely closed insertion tip is supposed to be achieved, it is provided that the front end of the insertion tip is closed by means of mechanical forming after flow forming.

Figure 2:
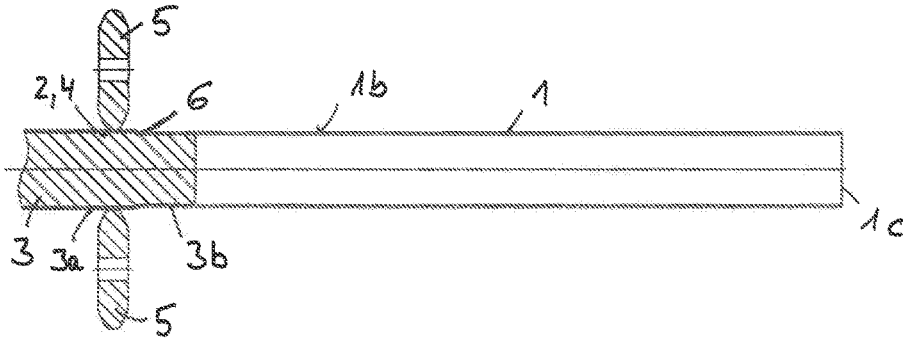
Figure 3:
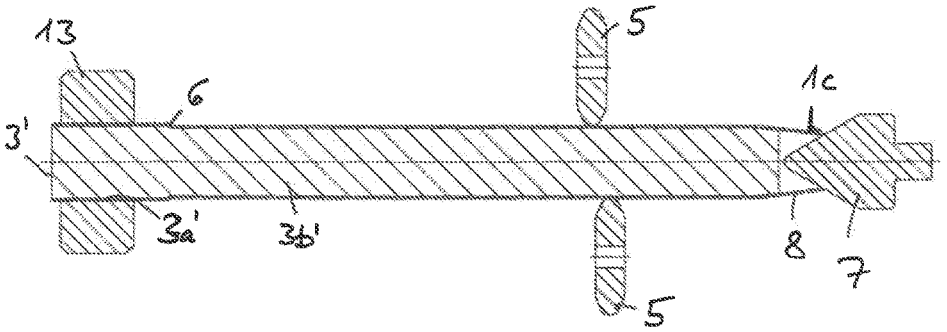
Figure 4:
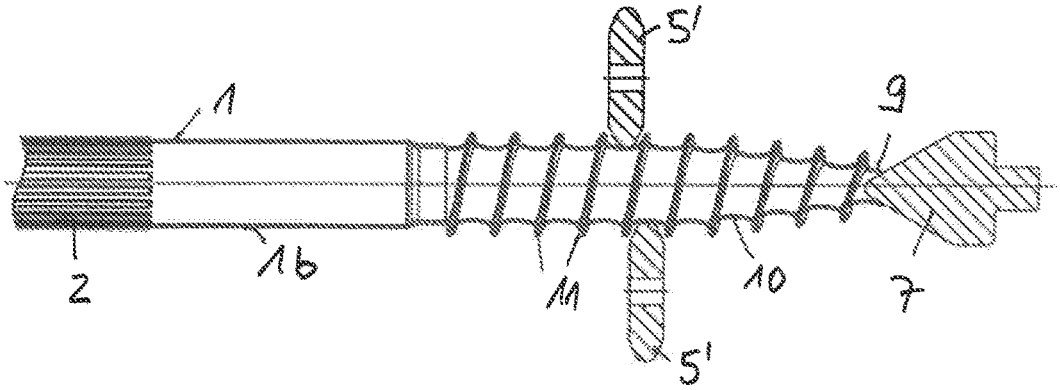
Figure 5:
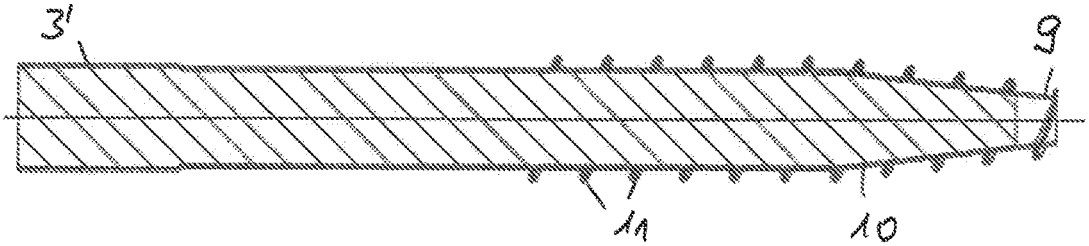
Figure 6:
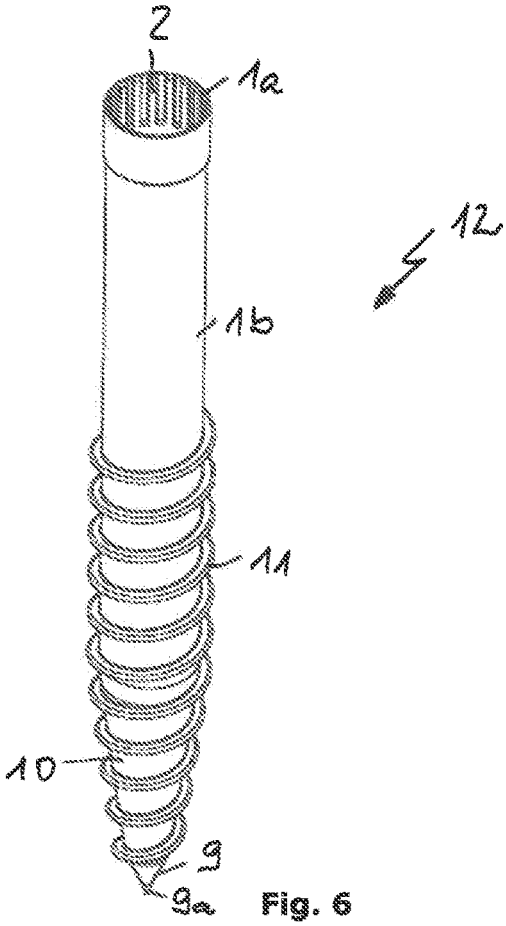

The invention will be explained in greater detail below, using an example shown in the drawing. The figures show:

FIG. 1 a longitudinal section through a cylindrical tube as an initial form, FIG. 2 a longitudinal section through the tube while an inner contour is pressed into it, FIG. 3 a longitudinal section through the tube during elongation, FIG. 4 a longitudinal section through the tube while a thread-like contour is pressed into it, FIG. 5 a longitudinal section through the tube after flow forming, and FIG. 6 a perspective representation of the finished ground screw foundation.

First of all, it should be pointed out that the scale is not the same in the individual figures.

For a method for the production of a ground screw foundation for securing elements in the ground, first of all a cylindrical tube 1 is provided as an initial form. This tube 1 can be a drawn or welded tube made of metal.

In the method sequence shown, the tube 1 is clamped into a flow forming machine, not shown in any detail, and first an inner contour 2 in the form of a spline shaft is formed in the rear end 1*a* by means of flow forming. For this purpose, an inner mandrel 3 is inserted into the rear end 1*a* of the tube 1, which mandrel, on its outer side, has an outer contour 4 that is complementary to the inner contour 2. This outer contour 4 is configured in a center region 3*a* of the inner mandrel 3; axially toward the left or outside, the inner mandrel 3 has an outer region without an outer contour, not shown, for being jointly clamped into a chuck 13 together with the rear end 1*a* of the tube 1. Axially toward the right or inside, the inner mandrel 3 has an inner region 3*b* that has a diameter that is smaller in comparison with the center region 3*a*, so as to be able to reduce the outside diameter of the tube 1 adjacent to the inner contour 2 of the tube 1 that is to be formed.

After the inner mandrel 3 has been set into the rear end 1*a* of the tube 1, two spinning rollers 5, for example, arranged symmetrically on the circumference, are set radially against the rear end 1*a* of the tube 1 and moved axially along the inner mandrel 3. As a result, the inner contour 2 is formed in the tube 1, and axially adjacent to it, a step 6 having a diameter reduction is produced on the tube 1. In this process, of course, the spinning rollers 5 are put into a rotational movement relative to the tube 1, i.e. either the tube 1 is put into a rotational movement, or driven spinning rollers 5 are used.

If this is desirable for geometrical reasons (tube lengthening) and/or reasons of strength, the tube 1 is then elongated axially, in that the spinning rollers 5 are moved to the right, in the axial direction, while being radially set against the tube 1. For this purpose, the inner mandrel 3 can be replaced by an inner mandrel 3', which differs from the inner mandrel 3 only in that the inner region 3*b'* is longer. Alternatively, elongation can also take place without an inner mandrel.

In FIG. 2, the elongated region of the tube 1 that borders on the step 6 has already been shown and identified as 1*b*, although FIG. 2 still shows the inner mandrel 3 in engagement. In fact, however, elongation only takes place after removal of the inner mandrel 3 and insertion of the inner mandrel 3' (FIG. 3). In this regard, a tailstock 7 can already have been introduced into the open front end 1*c* of the tube 1. This tailstock 7 can be controlled under the effect of a spring or by machine. The tailstock 7 serves as a support surface for the front end 1*c* of the tube 1, so as to produce a conically tapering region 8 by means of radially setting the spinning rollers 5 (FIG. 3).

This conically tapering region 8 is further shaped by the spinning rollers 5 to produce a conical front section 10 that is still open toward the front and tapers to an insertion tip 9, for which purpose spinning rollers 5 are pressed radially more and more against the tube 1 in the direction toward the insertion tip 9.

Afterward or at least at the same time with the conical deformation of the front section, a thread-like contour 11 is formed on the front section 10 by spinning rollers 5', specifically preferably not only on the front section 10, but rather also adjacent to the cylindrical, elongated region 1*b* of the tube 1, at least in certain regions (FIGS. 4 and 5).

In FIG. 5, the flow forming processes have been concluded, and the tailstock 7 has been pulled out of the tube 1. For final production of the ground screw foundation 12 for securing elements into the ground, it is now only necessary to close off the front end of the insertion tip 9. This is done by means of suitable shaping, for example by means of compression, punching or folding, and, if necessary, subsequent trimming.

The final ground screw foundation 12 is shown in FIG. 6.

Of course the invention is not restricted to the exemplary embodiments shown. Further embodiments are possible without departing from the basic idea. For example it is not necessary for the inner contour 2 to be produced first; this method step can also be carried out at a later point in time. The formation of the thread-like contour 11 can also take place at the same time with shaping of the front section 10, at least part of the time. The inner contour 2 can also be formed (or pre-formed) by means of tightening the chuck 13 while the inner mandrel 3 is inserted, at least part of the time.

REFERENCE SYMBOL LIST

1 cylindrical tube
1*a* rear end
1*b* elongated region
1*c* front end
2 inner contour
3, 3' inner mandrel
3*a*, 3*a'* center region
3*b*, 3*b'* inner region
4 outer contour
5 spinning rollers
6 step
7 tailstock
8 conically tapering region
9 insertion tip
9*a* front end
10 front section
11 thread-like contour
12 ground screw foundation
13 chuck

The invention claimed is:

1. A method for producing a ground screw foundation for securing elements in the ground, the method comprising:
providing a cylindrical tube as an initial form, and
subsequently forming a conical front section on the cylindrical tube, using a non-cutting process, wherein the conical front section tapers to an insertion tip, wherein at least sections of the conical front section have a thread-like contour so that the conical front section can be screwed into the ground, and
forming an inner contour for receipt of a screw-in tool on a rear end of the cylindrical tube by a flow forming,
wherein the conical front section and the thread-like contour are exclusively formed by the flow forming.

2. The method according to claim 1,
wherein at least sections of the cylindrical tube are first elongated.

3. The method according to claim 1,
wherein the conical front section is formed first, and after the conical front section is formed the thread-like contour is formed.

4. The method according to claim 3,
further comprising forming the thread-like contour in at least portions of a region of the cylindrical tube that borders on the conical front section.

5. The method according to claim 1,
wherein the conical front section and the thread-like contour are formed at the same time.

6. The method according to claim 1,
wherein the cylindrical tube is arranged on an inner mandrel during at least part of the flow forming.

7. The method according to claim 6,
wherein the inner mandrel comprises a multi-part internal mandrel.

8. The method according to claim 1,
wherein a tailstock is introduced into the conical front section during at least part of the flow forming.

9. The method according to claim 8,
wherein the tailstock is controlled under an impact of a spring or is machine-controlled.

10. The method according to claim 1,
wherein a front end of the insertion tip is mechanically closed after the flow forming.

* * * * *